US006481802B1

(12) United States Patent
Kussel

(10) Patent No.: US 6,481,802 B1
(45) Date of Patent: Nov. 19, 2002

(54) CONTROL SYSTEM FOR LONGWALL FACE ALIGNMENT

(75) Inventor: Willy Kussel, Werne (DE)

(73) Assignee: Tiefenbach Bergbautechnik GmbH, Essen (DE)

( * ) Notice: Subject to any disclaimer, the term of this patent is extended or adjusted under 35 U.S.C. 154(b) by 0 days.

(21) Appl. No.: 09/582,153

(22) PCT Filed: Oct. 19, 1999

(86) PCT No.: PCT/DE99/03349

§ 371 (c)(1),
(2), (4) Date: Aug. 8, 2000

(87) PCT Pub. No.: WO00/23690

PCT Pub. Date: Apr. 27, 2000

(30) Foreign Application Priority Data

Oct. 21, 1998 (DE) ..... 198 48 538

(51) Int. Cl.[7] ..... E21C 35/24
(52) U.S. Cl. ..... 299/1.6
(58) Field of Search ..... 299/1.7, 1.6

(56) References Cited

U.S. PATENT DOCUMENTS

| | | | | |
|---|---|---|---|---|
| 3,320,001 A | | 5/1967 | Allen et al. | |
| 3,378,303 A | * | 4/1968 | Weber | 299/1.7 |
| 3,643,445 A | | 2/1972 | Schmidt | |
| 4,130,319 A | * | 12/1978 | Gapper | 299/1.6 |
| 4,228,508 A | | 10/1980 | Benthaus | |
| 4,330,154 A | | 5/1982 | Harris | |
| 4,466,667 A | * | 8/1984 | Poulsen et al. | 299/1.6 |
| 4,518,285 A | | 5/1985 | Weber et al. | |
| 5,020,860 A | | 6/1991 | Bessinger et al. | |
| 5,029,943 A | * | 7/1991 | Merriman | 299/1.6 |
| 5,110,187 A | | 5/1992 | Heintzmann et al. | |
| 5,137,336 A | * | 8/1992 | Merten | 299/1.7 |
| 5,234,256 A | | 8/1993 | Demircan et al. | |
| 5,275,469 A | | 1/1994 | Geuns et al. | |

FOREIGN PATENT DOCUMENTS

| | | |
|---|---|---|
| DE | 2 303 433 A | 8/1974 |
| DE | 31 14 305 A1 | 11/1982 |
| DE | 32 07 517 A1 | 9/1983 |
| DE | 401 18 035 A1 | 12/1990 |
| DE | 42 02 246 A1 | 8/1992 |
| DE | 195 46 427 A1 | 8/1996 |
| GB | 1 210 069 | 10/1970 |
| GB | 2 254 640 A | 10/1992 |
| GB | 2 265 652 A | 10/1993 |

* cited by examiner

*Primary Examiner*—Heather Shackelford
*Assistant Examiner*—John Kreck
(74) *Attorney, Agent, or Firm*—Alston & Bird LLP

(57) ABSTRACT

In a control system for the longwall support with a plurality of hydraulically actuated supports (mining shields), which are each automatically rearranged in the sense of robbing, advancing, and setting as a function of the position of the mining machine (coal cutter or plow), the position of the mining machine is automatically signaled to the mining shield control system. To this end, the mining machine is equipped with a position signaler. A microprocessor (31), which receives the signals of the position signaler, converts the signals into position signals and/or signals of the direction of movement. A radio set (32) transmits the position signals and/or signals of the direction of movement to radio receivers (33), which are distributed over the mining section and connected to the mining shield control system (34) for converting the position signals and/or signals of the direction of movement into signals for rearranging the mining shields (longwall support devices 1–18).

13 Claims, 2 Drawing Sheets

CONTROL SYSTEM FOR LONGWALL FACE ALIGNMENT

BACKGROUND OF THE INVENTION

The invention relates to a control system for a longwall support with a plurality of hydraulically actuated supports (mining shields).

A longwall control system of this type is known from DE P42 02 246.0. In this system, the mining shields are adapted for automatic rearrangement in the sense of robbing, advancing, and setting as a function of the position of the mining machine (coal cutters or plows). To this end, the position of the mining machine is automatically signaled to the mining shield control system via a double pulse generator and a trailing cable that is pulled along by the mining machine. This control system has the disadvantage that the layout of such a cable is expensive and subjected to the risk of damage and considerable wear. This again results in hazards for the safe support of the longwall by false messages and incorrect controls.

It is accordingly an object of the present invention to provide an improved control system for a longwall support.

SUMMARY OF THE INVENTION

The above and other objects and advantages of the present invention are achieved by the provision of control system for a longwall support having a plurality of hydraulically operated supports that are automatically arranged via a mining shield control system in the sense of robbing, advancing, and setting as a function of the position of a mining machine that travels along and removes rock from the longwall. The control system comprises a position signaler that is carried by the mining machine. The position signaler comprises a rotatable measuring wheel that rotates in response to the mining machine traveling along the longwall and comprises electromagnetically detectable circumferential markings. For example, the rotatable measuring wheel can be a pinion. The position signaler further comprises a detector for sensing the electromagnetically detectable circumferential markings and providing a signal derived from the sensing. More specifically, the detector can be two inductive pulse generators (a double pulse generator), which scan or scans the electromagnetically detectable circumferential markings. The position signaler further comprises a microprocessor for receiving the signal from the detector and converting the signal into a processed signal, namely position signals and/or signals of the direction of movement. The position signaler further comprises a radio transmitter for transmitting the processed signal to the mining shield control system for use in the automatic arrangement of the hydraulically operated supports. The mining shield control system comprises one or more radio receivers that are distributed along the length of the longwall for receiving the transmitted processed signal from the position signaler. The mining shield control system converts the processed signal received by the radio receiver(s) into signals for rearranging the hydraulically operated supports.

DETAILED DESCRIPTION OF EXEMPLARY EMBODIMENT

Figure 2:
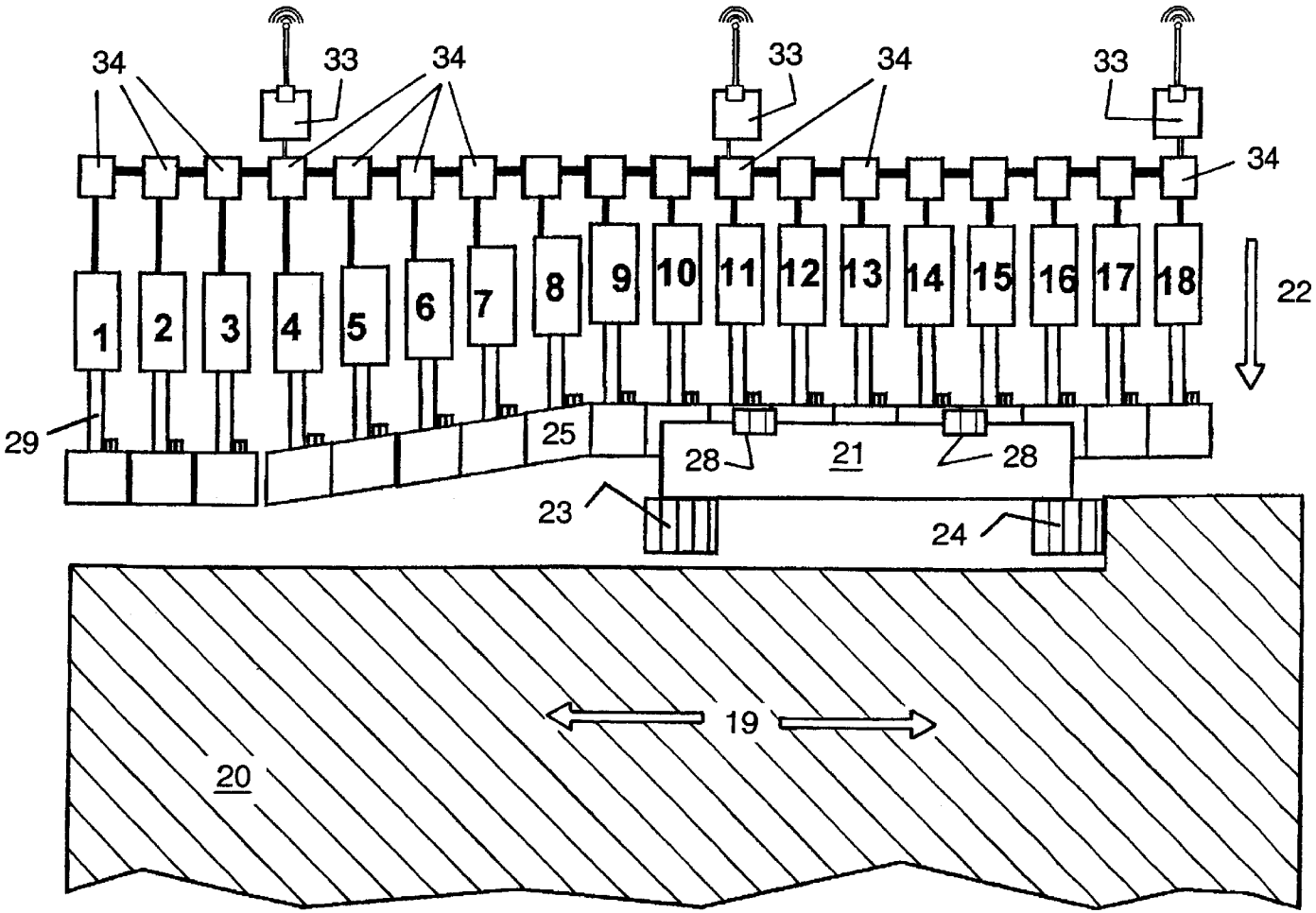
FIG. 2 is a view of a cutting machine.

FIG. 2 illustrates longwall support units 1–18. These support units are arranged along a coal bed 20. The coal bed

20 is mined in a working direction 22 with a cutting device 23, 24 of an extraction machine in the form of a coal cutting machine 21. The coal cutting machine 21 is movable in a cutting direction 19 by means of a cable not shown. It possesses two cutting rolls 23, 24 that are adjusted to different heights, and shear the coal face. The dislodged coal is loaded by the coal cutting machine, also named "cutter-loader," on a conveyor 25. The conveyor 25 consists of a channel, in which an armored conveyor is moved along the coal face. The coal cutting machine 21 is adapted for moving along the coal face. The channel is subdivided into individual units, which are interconnected and capable of performing a movement relative to one another in the working direction 22. Each of the units connects by means of a cylinder-piston unit (advance piston) 29 to one of the longwall support units 1–18. Each of the longwall support units serves the purpose of supporting the longwall. To this end, a further cylinder-piston unit is used, which stays a base plate relative to a roof plate. At its front end facing the coal bed, the roof plate mounts a so-called coal face catcher. This catcher is a flap that can be lowered to the mined coal face. The coal face catcher must be raised ahead of the approaching coal cutting machine 21. Likewise to this end, a further cylinder-piston unit not shown is used.

In FIG. 2, the coal cutting machine moves to the right. For this reason, it is necessary that the coal face catcher of the longwall support unit 17 be folded back. On the other hand, the channel of longwall support unit 9, which is located behind the coal cutting machine 21, is advanced in the direction toward the mined coal face. Likewise, the following longwall support units 8, 7, 6, 5, and 4 are in the process of advancing in the direction toward the longwall or the mined coal face. The coal face catcher on these longwall support units has already been lowered again. The support units 3, 2, 1 have finished their approach and remain in this position, until the coal cutting machine approaches again from the right.

Figure 1:
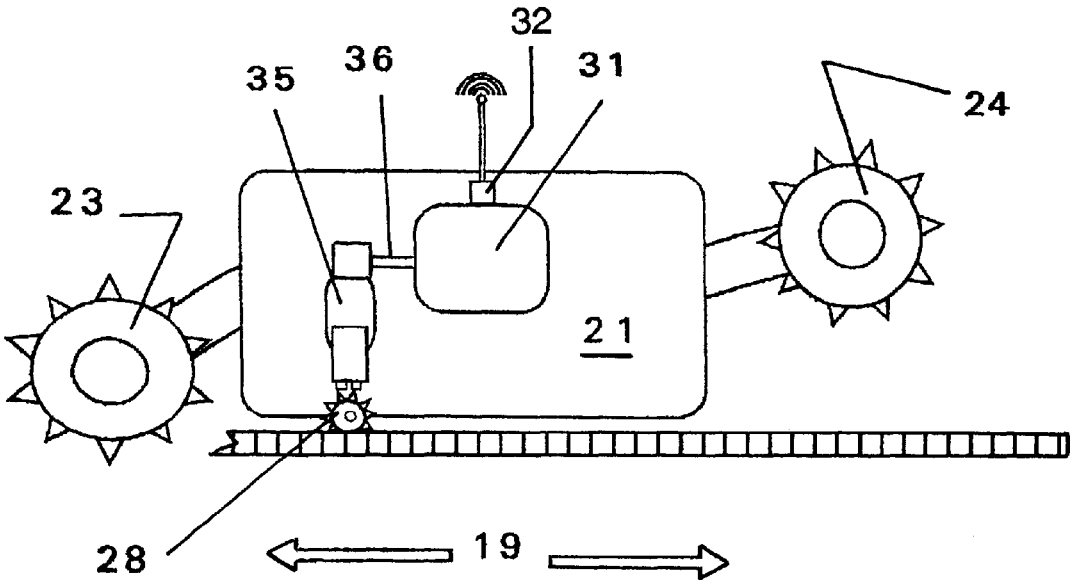
FIG. 1 is a schematic top view of a coal cutting machine.

Referring to FIG. 1, controlling this movement, a detector 35 is arranged on the coal cutting machine. In this instance, the detector comprises two electromagnets, which are arranged, one after the other, in the direction of travel. These electromagnets cooperate with a measuring wheel 28, which is arranged on the coal cutting machine 21. This wheel serves to sense the movement of the coal cutting machine. On its circumference, the measuring wheel possesses magnetically inhomogeneous places, which are shown in FIG. 1 by a gear tooth system. This arrangement enables both electromagnets of the detector 35 to detect the rotation of the wheel. Thus, two signals are constantly released during the advance of the coal cutting machine. The sequence of the signals emitted by the electromagnets makes it also possible to determine the direction of movement of the coal cutting machine. The signals of the detector are transmitted, via a line 36 to a computer microprocessor 31, which is mounted on the coal cutting machine. In the computer, the signals are added, to provide a single which indicates the position (position signal) of the coal cutting machine. Furthermore, the signals are analyzed for their sequence. From that, a signal is derived which represents the travel direction of the coal cutting machine (travel direction signal). The computer forwards the two signals, position signal and travel direction signal, to a radio set 32 connected to it. Referring to FIG. 1, this radio set transmits the signals to three stationary radio receivers 33, which connect each to one of control devices 34. Each of the control devices 34 connects to one longwall support unit. The control devices 34 are also connected to one another.

As the coal cutting machine approaches, the radio receivers, and via same the control devices 34 of the longwall support units receive two signals, namely the position signal and the travel direction signal. Based on these signals and the sequence of the signals, the position and the travel direction of the coal cutting machine are identified, and it is determined in the addressed control devices which longwall support unit must be operated. FIG. 2 illustrates the situation, in which the control device 34 of longwall support unit 17 must be addressed, since the coal cutting machine approaches same. For this reason, the control device 34 emits the signals necessary for retracting the coal face catcher to the longwall support unit 17, and possibly already to unit 18, and the necessary advance signals to the following longwall support units 9, 8, 7, 6, 5, 4.

As a result of enabling an accurate geometric association of position and direction of movement of the coal cutting machine by the detector 35 and the control device 34, which are associated to each of the longwall support units, it is possible to operate the coal cutting machine and the longwall support in a reliable, troublefree, and robust manner, requiring the least amount of operations. It has been found that even in the underground operation, a reliable, troublefree radio transmission of the necessary position and direction signals is possible, and that it is possible to control the longwall support control system in a reliable manner via one or few radio receivers, even in the case of a considerable length of the longwall. To this end, the control device has the characteristic that signals, which are transmitted to one or individual of the control devices, are forwarded to the remaining control devices, and that it enables, via the common computer capacity, a reliable determination of the longwall support units that are to be addressed each time. As regards a technical arrangement, reference may be made to DE 195 46 427.3

What is claimed is:

1. A control system for a longwal support having a plurality of hydraulically operated support units that are automatically arranged via a mining shield control system in the sense of robbing, advancing, and setting as a function of the position of a mining machine that travels along and removes rock from the longwall, the control system comprising:

a position signaler carried by the mining machine and comprising:

a rotatable measuring wheel that rotates in response to the mining machine traveling along the longwall and comprises electromagnetically detectable circumferential markings, a detector for sensing the electromagnetically detectable circumferential markings and providing a signal derived from the sensing, a microprocessor for receiving the signal from the detector and converting the signal from the detector into a processed signal, and a radio transmitter for transmitting the processed signal to the mining shield control system for use in the automatic arrangement of the hydraulically operated support units; and wherein the mining shield control system comprises:

a plurality of radio receivers that are distributed along the length of the longwall for substantially directly receiving the transmitted processed signal, and the mining shield control system converts the processed signal received by at least one of the radio receivers into signals for rearranging the support units, and a plurality of control devices, wherein each of the control devices is connected to a respective one of the support units for controlling the respective support unit, each of the radio receivers is substantially directly connected to a respective one of the control devices for substantially directly passing signals received by any one of the radio receivers to its respective control device, and the control devices are connected to one another so that a signal received by one of the radio receivers is provided from its respective control device to all other of the control devices and the mining shield control system is operative to determine which of the support units are to be addressed by the signal.

2. The system according to claim 1, wherein the detector comprises two inductive pulse generators.

3. The system according to claim 1, wherein the microprocessor is operative so that the processed signal comprises a signal indicative of the position of the mining machine.

4. The system according to claim 1, wherein the microprocessor is operative so that the processed signal comprises a signal indicative of the direction of movement of the mining machine.

5. The system according to claim 1, wherein the microprocessor is operative so that the processed signal comprises a signal indicative of the direction of movement of the mining machine and a signal indicative of the position of the mining machine.

6. The system according to claim 1, wherein the plurality of radio receivers includes at least three radio receivers.

7. The system according to claim 1, wherein the radio receivers are fewer in number than the hydraulically operated support units.

8. The system according to claim 7, wherein the radio receivers are fewer in number than the control devices.

9. The system according to claim 7, wherein the plurality of radio receivers includes at least three radio receivers.

10. The system according to claim 9, wherein the microprocessor is operative so that the processed signal comprises a signal indicative of the direction of movement of the mining machine and a signal indicative of the position of the mining machine.

11. The system according to claim 10, wherein the detector comprises two inductive pulse generators.

12. The system according to claim 1, wherein the radio receivers are fewer in number than the control devices.

13. The system according to claim 12, wherein the plurality of radio receivers includes at least three radio receivers.

* * * * *